US009376756B2

(12) United States Patent
Siskin et al.

(10) Patent No.: US 9,376,756 B2
(45) Date of Patent: Jun. 28, 2016

(54) INHIBITION OF CORROSION IN BOILER SYSTEMS WITH ETHERAMINES

(71) Applicants: Michael Siskin, Westfield, NJ (US); Robert Basil Fedich, Long Valley, NJ (US); Michel A. Daage, Hellertown, PA (US)

(72) Inventors: Michael Siskin, Westfield, NJ (US); Robert Basil Fedich, Long Valley, NJ (US); Michel A. Daage, Hellertown, PA (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 119 days.

(21) Appl. No.: 14/285,686

(22) Filed: May 23, 2014

(65) Prior Publication Data

US 2014/0255250 A1 Sep. 11, 2014

Related U.S. Application Data

(62) Division of application No. 13/471,797, filed on May 15, 2012, now Pat. No. 8,771,594.

(51) Int. Cl.

| | |
|---|---|
| ***C23F 11/14*** | (2006.01) |
| ***F22B 1/00*** | (2006.01) |
| ***F22B 37/02*** | (2006.01) |

(52) U.S. Cl.

CPC ..... *C23F 11/146* (2013.01); *C23F 11/141* (2013.01); *F22B 1/00* (2013.01); *F22B 37/025* (2013.01)

(58) Field of Classification Search

CPC ..... C23F 11/141
USPC ..... 422/7, 16
See application file for complete search history.

(56) References Cited

U.S. PATENT DOCUMENTS

| | | | |
|---|---|---|---|
| 4,405,583 | A | 9/1983 | Stogryn et al. |
| 4,405,585 | A | 9/1983 | Sartori et al. |
| 4,471,138 | A | 9/1984 | Stogryn |
| 4,894,178 | A | 1/1990 | Ho et al. |
| 5,799,621 | A | 9/1998 | Gordon et al. |
| 6,585,933 | B1 | 7/2003 | Ehrhardt et al. |
| 2010/0037775 | A1 | 2/2010 | Siskin et al. |

OTHER PUBLICATIONS

Explain that Stuff. "Gas central heating boilers". Wayback Machine capture from Aug. 24, 2009.*
Boiler Consortium. "Steam Basics". Mar. 2005.*
M.L. Gonzalez-Barba and L. Spagnuolo, "Corrosion Mitigation Strategies for Amine Gas Treating Plants", Corrosion Management in Gas Processing Facilities Seminar, Bahrain, Nov. 28, 2007, Baker Hughes.

* cited by examiner

*Primary Examiner* — Sean E Conley
*Assistant Examiner* — Donald Spamer
(74) *Attorney, Agent, or Firm* — Malcolm D. Keen; Glenn T. Barrett; Andrew T. Ward

(57) ABSTRACT

Aminoethers are used as corrosion inhibitors in boiler systems in which a working fluid comprising water with an aminoether corrosion inhibitor is circulated from a heater to a utilization site at which the working fluid gives up energy and decreases in temperature. A preferred class of aminoethers are the alkoxytriethyleneglycol-tert-alkylamines such as methoxy triethyleneglycol-tert-butylamine.

6 Claims, No Drawings

INHIBITION OF CORROSION IN BOILER SYSTEMS WITH ETHERAMINES

CROSS REFERENCE TO RELATED APPLICATION

This application is a divisional application of U.S. patent application Ser. No. 13/471,797, filed on May 15, 2012.

FIELD OF THE INVENTION

This invention relates to a method of inhibiting corrosion in boiler systems used for raising steam or providing hot water.

BACKGROUND OF THE INVENTION

Boiler systems are widely used industrially and in residential application for raising steam or supplying hot water. Steam raising systems may supply saturated steam or superheated steam. In all boiler systems and their associated equipment, including piping, valves, heat exchangers, radiators, etc., the heated water or steam is circulated in a loop which may be open or closed. Most industrial boiler and residential boiler systems are constructed of carbon steel and equipment corrosion is a continuing and serious problem which has to be addressed both with proper equipment design and operation along with periodic inspection and maintenance.

The dissolved gases normally present in water cause many corrosion problems. For instance, oxygen in water produces localized pitting while carbon dioxide corrosion is frequently encountered in condensate systems and less commonly in water distribution systems. The resulting corrosion may lead either to removal of material as with pitting or to deposit formation on heat transfer surfaces to reduce efficiency and reliability.

A number of measures may be taken to inhibit, corrosion or its effects on the system. Proper feed-water selection and treatment, for example, by daeration, can contribute materially and chemical treatment can inhibit the direct effects of corrosion-inducing species or of the corrosion products which may be formed. Typical treatment chemicals include neutralizing amines, filming amines, and oxygen scavenger-metal passivators. Neutralizing amines are used to neutralize the acids generated by the dissolution of carbon dioxide or other acidic process contaminants in the water. Filming amines, by contrast, act by forming a protective film on metal surfaces which replaces loose oxide or sulfide scale present on the surfaces with a thin amine film barrier. Filming amines have, however, a tendency to form deposits by reacting with multivalent ions, such as sulfates, and certain metals frequently present in water supplies and so require addition in controlled amounts.

Filming amines containing one ingredient, such as hexadecylamine, octadecylamine and dioctyldecylamine are effective but often fail to cover the entire system and can produce fouling. Emulsifiers and, in some cases, small amounts of neutralizing amines can be added to improve film distribution by providing more uniform coverage and reducing fouling potential. Treatment with a combination, e.g., filming and neutralizing amines with dispersant aids, may provide superior corrosion protection.

One factor in the use of amine corrosion inhibitors is the distribution between the steam and water phases. In closed system in which both steam and water will be present, the distribution of the amine between the steam and liquid phases is significant: as the steam condenses, acidic contaminants can either remain in the steam or dissolve in the liquid phase.

Some contaminants, such as carbon dioxide, stay mainly in the steam phase while others go into the liquid phase. Amines that are more likely to distribute into the steam include cyclohexylamine but if it is used in a system with two condensation zones in series, acidic corrosion agents may deposit/condense into the liquid phase at the first condensation site while the cyclohexylamine will tend to remain in the steam. This results in low pH in the first condensation site liquid phase. At the second site, where total condensation takes place, the pH is high.

Thus, there is a considerable number of factors entering into the choice of amine corrosion inhibitors in boiler systems and additional amines and amine systems are desirable in this application.

SUMMARY OF THE INVENTION

According to the present invention, aminoethers are used as corrosion inhibitors in boiler systems. The aminoethers are known materials previously proposed as acidic gas absorbents with a number of them being commercially available for this purpose. The new area of application represents an extension of their utility with specific applications being dependent on the type of boiler system and the properties of the individual aminoether. Specific aminoethers are described below.

DETAILED DESCRIPTION

Utilization Systems

The term "boiler system" is used here to mean a system comprising a water heater connected to a closed or open loop fluid circuit for circulating water and/or steam from the heater to a utilization site, e.g., a heat exchanger, a radiator, a power source such as, for example, a turbine or an engine, an ejector or injector, in the utilization site, the water/steam gives up energy and decreases in temperature; if the temperature decrease is large enough, steam may condense. Typical closed loop systems include heating circuits, heat exchanger loops, condensing turbine circuits and condensing reciprocating engine circuits; it is in such circuits that the present aminoether corrosion inhibitors find their most significant utility. Circuits may be single phase circuits in which heated water is circulated or mixed phase circuits in which the water is wholly or partly evaporated to form steam which is condensed at one or more condensation sites in the circuit, in two phase circuits, the distribution of the aminoether between the phases will depend upon the aminoether molecular weight and other physical and chemical properties of the compound (s) as well as the operating parameters of the circuit, especially its temperature and pressure.

Aminoether Corrosion Inhibitors

The aminoether compounds proposed for use as corrosion inhibitors in boiler systems comprises a class of compounds known primarily for their utility for the absorption of acidic gases such as $H_2S$ and $CO_2$ from gas streams such a natural gas, syngas, etc. The preferred aminoethers are represented by derivatives of diethylene glycol or polyethylene glycols which contain severely sterically hindered amino groups as well as by their corresponding derivatives derivatized on the alcohol group to form the corresponding ether or ester derivatives and their corresponding sultanate and phosphonate salts. In general, the preferred severely sterically hindered aminoether derivatives will have a cumulative Es (Taft steric hindrance constant) value greater than 1.75 (see below for further explanation of this constant and its calculation).

Preferred examples of these aminoethers are disclosed in U.S. Pat. Nos. 4,405,583; 4,405,585, 4,471,138, 4,894,178 and U.S. Patent Publication 2010/0037775, to which reference is made for a full description of these materials, their synthesis and their use in selective acidic gas separation processes. The disclosures of the aminoethers are summarized below for convenience.

U.S. Pat. No. 4,405,583: The hindered diamino ethers disclosed in this patent are defined by the formula:

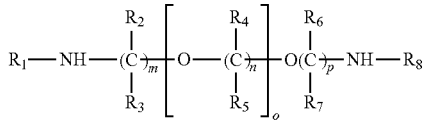

where $R^1$ and $R^8$ are each $C_1$ to $C_8$ alkyl and $C_2$ to $C_8$ hydroxyalkyl groups, $R^2$, $R^3$, $R^4$, $R^5$, $R^6$, and $R^7$ are each hydrogen, $C_1$-$C_4$ alkyl and hydroxyalkyl groups, with certain provisos to define the adequately hindered molecule and m, n, and p are integers from 2 to 4 and o is zero or an integer from 1 to 10. A typical diamino ether of this type is 1,2-bis(tert-butylaminoethoxy)ethane, a diamino derivative of triethylene glycol.

U.S. Pat. No. 4,405,585: The hindered amino ether alcohols disclosed in this patent are defined by the formula:

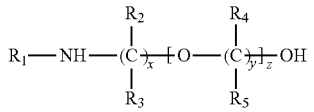

where $R^1$ is $C_1$-$C_8$ primary alkyl and primary $C_2$-$C_3$ hydroxyalkyl, $C_3$-$C_8$ branched chain alkyl and branched chain hydroxyalkyl and $C_3$-$C_8$ cycloalkyl and hydroxycycloalkyl, $R^2$, $R^3$, $R^4$ and $R^5$ are each hydrogen, $C_1$-$C_4$ alkyl and $C_1$-$C_4$ hydroxyalkyl radicals, with the proviso that when $R^1$ is a primary alkyl or hydroxyalkyl radical, both R2 and R3 bonded to the carbon atom directly bonded to the nitrogen atom are alkyl or hydroxyalkyl radicals and that when the carbon atom of $R^1$ directly bonded to the nitrogen atom is secondary at least one of $R^2$ or $R^3$ bonded to the carbon atom directly bonded to the nitrogen atom is an alkyl or hydroxyalkyl radical, x and y are each positive integers from 2 to 4 and z is an integer from 1 to 4. Exemplary compounds of this type include the amino ether alcohol tert-butylaminoethoxyethanol, a derivative of diethylene glycol.

U.S. Pat. No. 4,471,138: This patent discloses the desirability of using a combination of a diamino ether with an aminoether alcohol. The two compounds are represented by the respective formulae:

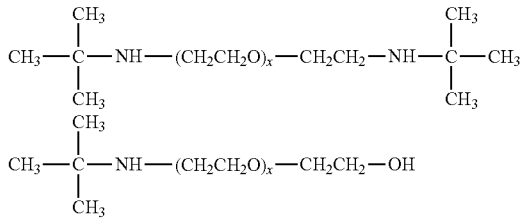

where x is an integer ranging from 2 to 6. This mixture can be prepared in the novel one-step synthesis, by the catalytic tertiary butylamination of a polyalkenyl ether glycol, HO—$(CH_2CH_2O)_x$—$CH_2CH_2$—OH, or halo alkoxyalkanol. For example, a mixture of bis-(tert-butylaminoethoxy)ethane (BTEE) and ethoxyethoxyethanol-tert-butylamine (EEETB) can be obtained by the catalytic tert-butylamination of triethylene glycol.

U.S. Pat. No. 4,894,178: A specific combination of diamino ether and aminoalcohol represented by the respective formulae:

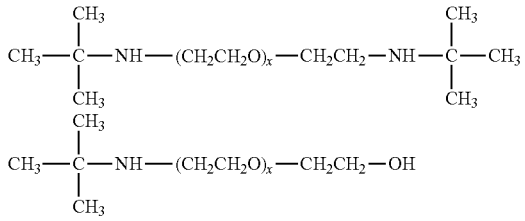

with x being an integer ranging from 2 to 6 and the weight ratio of the first amine to the second amine ranging from 0.23:1 to 2.3:1 and preferably 0.43 to 2.3:1. This mixture can be prepared in the one-step synthesis, by the catalytic tert-butylamination of the corresponding polyalkenyl ether glycol, for example, by the catalytic tert-butylamination of tri ethylene glycol.

US 2010/0037775: The reaction of a polyalkenyl ether glycol with a hindered amine such as tert-butylamine to form useful aminoether absorbents is improved by the use of an alkoxy-capped diethylene and triethylene glycols in order to preclude the formation of an unwanted cyclic by-product, tert-butyl morpholine (TBM). The preferred capped di- and diethylene and triethylene glycols include methoxy-triethylene glycol although the ethoxy-, propoxy- and butoxy homologs may also be used. The reaction between triethylene glycol and tert-butylamine is shown to produce a mixture of bis-(tert-butylaminoethoxy)ethane and tert-butylaminoethoxyethoxyethanol in a weight ratio of about 65-67%:33% for a total yield of about 95% of the mixture over an extended reaction time while the reaction with the alkoxy-capped glycol produces the mono-amino reaction product in comparable yield after a significantly shorter reaction time.

The aminoether compounds may be used in conjunction with other amine corrosion inhibitors such as the neutralizing amines and filming amines, e.g., hexadecylamine, octadecylamine or diotadecylamine as well as with other types of additive generally useful in boiler systems.

A preferred class of aminoethers for use in boiler systems in offshore use, e.g., in marine boilers and offshore production platforms, is defined by the formula:

$$R^1—NH—[C_nH_{2n}—O—]_x—OY$$

where $R^1$ is a secondary or tertiary alkyl group of 3 to 8 carbon atoms, preferably a tertiary group of 4 to $ carbon atoms, Y is H or alkyl of 1 to 6 carbon atoms, n is a positive integer from 3 to 8 and x is a positive integer from 3 to 6. The preferred $R^1$ group is tertiary butyl and the most preferred amino ethers are those derived from triethylene glycol (n is 2, x is 3). When Y is H, the amino ether is an amino ether alcohol such as tert-butylamino ethoxyethoxyethanol, derived from triethylene glycol; when Y is alkyl, preferably methyl, the amino ether is an alkoxy amino ether, with preference for tert-butylamino methoxy-ethoxyethoxyethanol. The monoamino ethers may be used in blends with diamino ethers in which the terminal OH group of the ether alcohol or the terminal alkoxy group of the alkoxy amino ether is replaced by a further hindered amino group as expressed in the formula:

$$R^1—NH—[C_nH_{2n}—O—]_x—NHR^2$$

where $R^1$, n and x are as defined above and $R^2$, which may the same or different to $R^1$, is a secondary or tertiary alkyl group of 3 to 8 carbon atoms. A preferred diamino ether of this type is bis-(t-butylamino ethoxy)ethane which may conveniently be used as a mixture with tert-butylamino methoxy-ethoxy-ethoxyethanol in a weight ratio of about 65-67 wt %:33-35 wt % or 33.3-35 wt %:65-66.7 wt %.

The secondary aminoethers mentioned above are characterized by acyclic or cyclic moieties attached to the amino nitrogen atom(s). The term "severely sterically hindered" signifies that the nitrogen atom of the amino moiety is attached to one or more bulky carbon groupings. Typically, the severely sterically hindered aminoether alcohols have a degree of steric hindrance such that the cumulative Es value (Taft's steric hindrance constant) greater than 1.75 as calculated from the values given for primary amines in Table V in a F. DeTar, Journal of Organic Chemistry, 45, 5174 (1980), to which reference is made for a description of this parameter. Further discussion of the steric hindrance factor is given in the patents mentioned above, to which reference is made for such a discussion.

The diethylene and triethylene glycol alkoxy aminoethers described in U.S. 2010/0037775 are proposed for use in systems where distribution into the steam phase is desirable since the alkoxy end group prevents hydrogen bonding either between molecules of the aminoether itself or with the water in the system, so favoring a lower boiling point than would be expected from the molecular weight alone. The use of the alkoxytriethyleneglycol-tert-alkylamines such as methoxy triethyleneglycol-tert-butylamine is particularly favored for such applications.

While useful in low and medium pressure boiler systems, e.g., with saturated steam or with only a moderate degree of superheat, e.g., up to steam temperatures of about 150° C., utility in higher temperature steam circuits, e.g., up to about 250 or 300° C. is contemplated. The stability of the ethers is relatively high, making them potentially useful in such applications.

The invention claimed is:

1. A method of inhibiting corrosion in a boiler system in which a working fluid comprising water is circulated from a heater to a utilization site at which the working fluid gives up energy and decreases in temperature, comprising adding an aminoether corrosion inhibitor to the water; wherein the aminoether comprises diamino ether and an aminoether alcohol represented by the respective formulae:

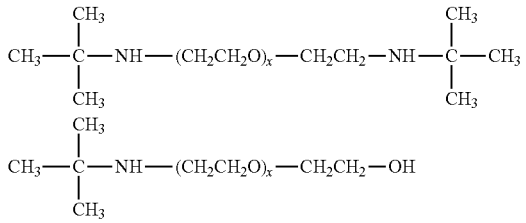

where x is an integer ranging from 2 to 6.

2. A method according to claim 1 wherein the boiler system is a single phase, closed loop system in which the water is heated in the heater.

3. A method according to claim 1 wherein the boiler system is a closed loop system in which the water is converted to steam in the heater and condensed to water in at least one condensation site in the circuit.

4. A method according to claim 3 wherein the steam temperature is up to about 250° C.

5. A method according to claim 1 wherein the weight ratio of the diamino ether to the aminoether alcohol ranges from 0.23:1 to 2.3:1.

6. A method according to claim 1 in which the aminoether comprises a mixture of bis-(tert-butylaminoethoxy)ethane and tert-butyl aminoethoxy ethoxy ethanol.

* * * * *